US005891305A

United States Patent [19]

Dondeyne et al.

[11] Patent Number: 5,891,305

[45] Date of Patent: Apr. 6, 1999

[54] PROCESS FOR THE MANUFACTURE OF PAPER

[75] Inventors: Marcel Dondeyne, Hinges; Jean-Yves Petit, Paris, both of France

[73] Assignee: Roquette Freres, Lestrem, France

[21] Appl. No.: 737,602

[22] PCT Filed: Mar. 28, 1996

[86] PCT No.: PCT/FR96/00468

§ 371 Date: Jan. 13, 1997

§ 102(e) Date: Jan. 13, 1997

[87] PCT Pub. No.: WO96/30591

PCT Pub. Date: Oct. 3, 1996

[30] Foreign Application Priority Data

Mar. 31, 1995 [FR] France ..... 95 03823

[51] Int. Cl.[6] ..... D21H 17/29

[52] U.S. Cl. ..... 162/175; 162/181.1; 162/181.2; 162/181.3; 162/183

[58] Field of Search ..... 162/175, 181.2, 162/181.3, 181.1, 183

[56] References Cited

U.S. PATENT DOCUMENTS

| | | | |
|---|---|---|---|
| 4,066,495 | 1/1978 | Voigt et al. . | |
| 4,332,935 | 6/1982 | Fischer et al. . | |
| 4,613,407 | 9/1986 | Hughette et al. | 162/175 |
| 4,902,382 | 2/1990 | Sakabe et al. | 162/175 |
| 4,911,790 | 3/1990 | Lindstrom et al. | 162/175 |
| 4,992,536 | 2/1991 | Billmers et al. . | |

FOREIGN PATENT DOCUMENTS

| | | |
|---|---|---|
| 0041056 | 12/1981 | European Pat. Off. . |
| 0139597 | 5/1985 | European Pat. Off. . |
| 0285486 | 10/1986 | European Pat. Off. . |
| 0233336 | 8/1987 | European Pat. Off. . |
| 0257338 | 3/1988 | European Pat. Off. . |
| 0276200 | 7/1988 | European Pat. Off. . |
| 0282415 | 9/1988 | European Pat. Off. . |
| 0285486 | 10/1988 | European Pat. Off. . |
| 0285487 | 10/1988 | European Pat. Off. . |
| 0303039 | 2/1989 | European Pat. Off. . |
| 0303040 | 2/1989 | European Pat. Off. . |
| 0333292 | 9/1989 | European Pat. Off. . |
| 0348366 | 12/1989 | European Pat. Off. . |
| 0406837 | 1/1991 | European Pat. Off. . |
| 0490425 | 6/1992 | European Pat. Off. . |
| 0522940 | 1/1993 | European Pat. Off. . |
| 2289674 | 5/1976 | France . |
| 2418297 | 9/1979 | France . |
| 2434821 | 3/1980 | France . |
| 2434821 | 9/1981 | France . |
| 2477159 | 9/1981 | France . |
| 1274654 | 5/1972 | United Kingdom . |
| WO 82/01020 | 4/1982 | WIPO . |
| WO 86/00100 | 1/1986 | WIPO . |

OTHER PUBLICATIONS

Paper Technology Sep. 1994 vol. 35—No. 7 "Cationic Starches" pp. 18–27.

*Primary Examiner*—Peter Chin
*Attorney, Agent, or Firm*—Henderson & Sturm

[57] ABSTRACT

The invention relates to a new process for the manufacture of paper which employs, in the fibrous composition, a cationic starch exhibiting a high level of fixed nitrogen, namely greater than 0.95%, and a polyaluminum compound, such as a (basic) aluminum polychloride or an aluminum polychlorosulphate.

This process makes it possible, including under difficult conditions (fibrous composition based on old papers, significant closure of the circuits), to improve the level of retention of starch and the physical characteristics of the paper, indeed to increase the machine speed by dispensing with the surface treatment optionally applied to the paper.

The process according to the invention is particularly suitable for the manufacture of paper for graphical use or of paper for wrapping or packaging and very particularly of fluting paper or of liner paper for corrugated fiberboard.

24 Claims, No Drawings

PROCESS FOR THE MANUFACTURE OF PAPER

The subject of the invention is a new process for the manufacture of paper, the term "paper" denoting, in the following text, any plane or sheet structure based not only on cellulose fibres, the most frequently used raw material in the paper and fibreboard industry, but also based:

on synthetic fibres, such as polyamide, polyester and polyacrylic resin fibres, on inorganic fibres, such as asbestos, ceramic and glass fibres, on any combination of cellulose, synthetic and inorganic fibres.

The use, which is well known, of cationic starches which are introduced into the mass of fibres before the formation of the sheet has made it possible overall to increase the retention of the fibres and fillers, to improve the draining and to enhance the physical characteristics of the paper. Indeed, the preferential fixation of these starches to the anionic reaction sites of the fibres and fillers, made possible by their cationic nature or cationicity, enables the number of bonds between fibres and between fibres and fillers to be increased, resulting in a greater strength of the paper. By virtue of this greater strength of the paper, it became possible to decrease the concentration of the mass of fibres and to resort to fibres of lower quality.

However, it has been known for several years that the abovementioned advantages provided by the use of cationic starches do not always make it possible to compensate for the increasing disadvantages created by the increasing deterioration in the quality of the raw materials.

In fact, in the face of increasingly severe concerns about economic profitability, not only has the semi-chemical pulp conventionally used, for example for the manufacture of paper for corrugated fibreboard, seen its share reduced to the advantage of pulps made from recovered cellulose fibres, commonly known as RCFs, but the quality even of these RCFs is furthermore increasingly mediocre due to the increasing number of recyclings of "old papers".

To this may be added the fact that, as regards paper machines, the trend is increasingly towards the systematic closure of circuits, resulting in the process waters becoming enriched in suspended matter, both organic and inorganic. This undesirable or polluting matter contains, in particular, extremely varied physicochemical species, including those of colloidal nature, which exhibit an anionic nature and which are commonly grouped under the generic term of "anionic trash".

Their forever increasing presence in the process waters means that any cationic starch used is increasingly drawn towards neutralizing or becoming fixed to the said anionic trash and, correlatively, increasingly less available for becoming fixed to the reaction sites of the fibres, resulting in a decrease in the level of starch retained on the sheet and a decreased strength of the latter.

Generally, whatever the degree of cationicity of the starches, the closure of the circuits and the deterioration in the quality of the fibres are reflected in an inevitable fall in the effectiveness (including retention on the sheet) of the starches and in the strength of the papers, as well as in a virtually automatic increase in the purification requirements of the backwaters of the paper machines, also known as "white waters".

Starting from the principle that the effectiveness of a cationic starch had to increase as its probability of fixation to the fibres increased, recourse was had, in order to increase this probability of fixation, to combinations of the "cationic starch - polyacrylamide" type (U.S. Pat. No. 4,066,495), "cationic starch - aluminium sulphate" type or "cationic starch - basic alumina salt" type (Patent FR 2,418,297).

Recourse was also had, as described in European Patent EP 0,139,597 granted in the name of the Applicant Company, to "cationic cereal starch - cationic tuber starch" combinations, the said cationic starches advantageously having, according to the examples of the said patent, a relatively low level of fixed nitrogen on a dry basis, namely lying between 0.20 and 0.30%.

The abovementioned technology combining cationic starch and basic aluminium salt has formed the subject, in particular since the end of the 1980s, of many studies with a view to remaining constantly up-to-date with respect to the requirements of a technical (general quality of the paper), economic (speed of the machines, in particular) and regulatory (protection of the environment in particular) nature which paper manufacturers must meet.

These requirements have in particular had the effect of recommending, as described in European Patent EP 0,276,200, the combination of a cationic polysaccharide and an aluminium compound of anionic nature, which is generally formed in situ by the use of alkali, under conditions such that the pH of the fibrous mass has to be held at a precise value (7 to 8) at a precise spot in the paper machine, namely immediately before the head box.

However, on reading this Patent EP 0,276,200, it is clear that such anionic aluminium compound/cationic polysaccharide combinations only make it possible to obtain the desired effect, namely a good retention of the fillers or fines, under specific operating conditions and in particular:

1) for very precise molar ratios of anions (contributed by the alkali—examples: $OH^-$ or $CO_3^{2-}$) to cations ($Al^{3+}$, contributed by the aluminium compound), 2) and for a precise order of introduction of the additives into the fibrous mass, namely the aluminium compound and then the cationic polysaccharide.

Moreover, it should be noted that Patent EP 0,276,200 does not in any way disclose the level of retention which can be obtained as regards the cationic starch used ("Cato 102" product having a level of fixed nitrogen of approximately 0.30%) or the physical characteristics of the paper resulting from the use of such cationic polymer/anionic aluminium compound combinations.

The abovementioned technical, economic and regulatory requirements have in particular had the effect of also recommending:

either, as described in European Patent EP 285,486, that the level of introduction of the cationic starch should be increased to levels of the order of 5%, expressed by weight with respect to the weight of fibres, in combination with an aluminium polychloride which is preferably used as close as possible to the head box of the paper machine, or, as described in European Patent EP 285,487, that relatively low levels of cationic starch (0.3–0.4% by weight of fibres) should be maintained but necessarily combining the said starch with an inorganic filler (in particular calcium carbonate) and with a sizing agent (in particular of alkylketene dimer or "AKD" type or of succinic acid anhydride or "SAA" type), as well as with an aluminium polychloride.

It should be noted that these two adjustments to the "cationic starch - basic aluminium salt" technology are mainly expressed for "head box" pH values of 7.2 or above (up to 7.8), for the purpose respectively of manufacturing paper of "liner for corrugated fibreboard" type, surface finished using native starch (Patent EP 285,486), or of "printing and writing", "offset printing" or "reprography" type (Patent EP 285,487).

In addition, these two documents do not in any way disclose the level of retention of the cationic starch used and, by subtraction, the level of cationic starch which was not able to become fixed within the sheet being formed and, by the same token, was able to contribute to organic pollution and to the non-profitability of the system.

Moreover, no details are given as regards the nature of the cationic starch used in the context of these two documents (level of fixed nitrogen, viscosity, botanical source, and the like).

Very recently, the combination of different starches of variable cationicity (DS of 0.032 to 0.11, corresponding to levels of nitrogen of 0.28 to 0.95) with different synthetic products capable of reducing the undesirable effects inherent in the presence, in the circuits, of anionic trash has been envisaged (Glittenberg et al. in "Paper Technology", Vol. 35, No. 7, pp. 18–27).

It appears that, among these anionic trash catchers, the products of PEI (polyethyleneimine) or p-DADMAC (polydialkyldimethylanmonium chloride) type are more effective than an aluminium polychloride (the chemical composition of which is not specified), which is presented as "virtually ineffective in terms of retention".

In any case, it should be noted that this document:

does not in any way describe the physical characteristics of the paper which may be obtained by combining a cationic starch and an aluminium polychloride, shows that, for certain parameters, a cationic starch with a DS of 0.11 is not significantly more effective than a cationic starch with a DS of 0.032 or 0.035, only truly studies the physical characteristics of the paper, evaluated on a "Retention Handsheet Machine", in the context of cationic starch/p-DADMAC combinations with use of a starch (C* Bond 05906 product) which is known to exhibit a relatively low level of nitrogen, in all cases less than 0.5%, generally diverts the person skilled in the art from envisaging cationic starches of higher DS values, and therefore of higher levels of nitrogen, which would "not be advantageous from an economic viewpoint".

With a view to improving the effectiveness of the cationic starches and the strength of the papers and/or lowering the levels of undesirable suspended matter contained in the white waters and secondary effluents ("clarified waters"), it has also been proposed to resort to polysaccharide binders, and in particular starches, containing both cationic groups and anionic groups, as described in Patents FR 2,289,674, EP 257,338 and Patent Application WO 81/00147.

Patent FR 2,289,674 describes the specific use, in media containing high concentrations of aluminium sulphate, of amphoteric starches of sulphosuccinate type of reduced cationicity (indicated degree of substitution or "DS" of 0.03, corresponding to a level of fixed nitrogen of less than 0.30% with respect to the dry weight of the starch), with a view to improving the retention of pigments of titanium dioxide type. In certain cases, the physical characteristics of the paper, expressed by the Mullen value alone, can be improved but to a very limited extent (maximum Mullen obtained: 1.59).

Patent EP 257,338 describes the specific use of amphoteric starches of phosphate type, in particular with a waxy base, with a cationicity which can be described as "low" or "medium" (maximum DS of 0.08, corresponding to a level of fixed nitrogen of less than 0.7%/dry weight of starch). This document envisages the advantage of such amphoteric starches solely from the viewpoint of improving the draining behaviour of the paper machine.

Patent Application WO 81/00147 describes the preparation, according to a complicated process, of an amphoteric mucus based on a cationic starch of reduced cationicity and of a polymer of CMC type intended for coating a filler/fibre structure.

In any case, the complexity and cost of preparation, the unsatisfactory behaviour and/or the limited application potential of such amphoteric starches reduce the industrial interest thereof.

For the purpose of improving the effectiveness of the cationic starches and the strength of the papers and/or of lowering the levels of pollution of the effluents resulting from the paper-making operation, techniques known as "dual" techniques have also been recommended in which, on the one hand, cationic polymers and, on the other hand, anionic compounds of inorganic and/or organic origin are combined. Such a technique, making separate use of a cationic starch and of an anionic starch, is in particular recommended in Patent EP 282,415, of which the Applicant Company is the proprietor.

Another dual technique is also described in Patent EP 41,056, which claims the combination of cationic starch and colloidal silicic acid. Such a combination has been improved over time, as is apparent from the description of Patent Application WO 86/00100 (anionic agent of aluminium silicate or silicic acid modified by aluminium type), of Patent EP 348,366 (anionic agent of silicic acid polymer type exhibiting a particular specific surface) and of Patent EP 490,425 (cationic agent containing from 0.05 to 0.5% by weight of aluminium).

Generally, it appears that the dual technique employing a silicic derivative as anionic agent had to become considerably more complex over time with a view to meeting the increasingly stringent requirements (technical, economic and/or regulatory) with which paper manufacturers are confronted.

The result was therefore the conception of:

ternary "cationic starch (DS=0.035)/specific silicic acid polymer/aluminium salt" systems as described in the abovementioned Patent EP 349,366, the said aluminium salt preferentially being chosen from alum, sodium aluminate or aluminium chloride, and lastly, binary systems making use of cationic starches carrying aluminium and prepared according to complex processes, as is apparent from reading Patents EP 303,039 or EP 303,040, cited in the abovementioned Patent EP 490,425.

In addition, Patents EP 349,366 and 490,425 mainly focus on the "draining" and/or "retention" aspects and do not really take up the study of the physical characteristics of the paper.

These dual techniques based on a silicic derivative result, as emphasized, in an improvement in the retention, thus making it possible to manufacture a paper with a higher content of fillers. They also make possible a substantial saving in cellulose but are not applicable in all cases. Moreover, as the amount of starch fixed to the cellulose at the time of the formation of the sheet still remains limited, the physical characteristics of the paper obtained are not always sufficiently improved.

For the purpose of improving the physical characteristics of a paper containing filler and sizing agent, much more sophisticated systems have recently been recommended (Patent EP 522,940), these systems being composed of a system known as a "retaining" system based on three constituents, in this case a cationic starch (DS of 0.01 to 0.1, corresponding to levels of fixed nitrogen <0.9%), an aluminium polychloride and anionic silica, the levels of introduction of which constituents must, in addition, be within very specific ranges.

It should be noted that, while such a ternary retaining system, based on the silica/aluminium polychloride synergy, makes it possible specifically to improve the look through of the paper (i.e. the homogeneity of the fibres in the plane and the thickness of the sheet), the said system does not make it possible to achieve levels of retention (overall retention) of the order of at least 80%.

The result of all the above is that there exists a real need to provide a means which makes it possible to manufacture paper which is simultaneously simple, profitable and does not generate pollution problems and which is capable of satisfying the current requirements of paper manufacturers, in particular in terms of the nature of the raw material (RCF for papers for corrugated fibreboard, for example), of the quality of the finished product (strength of the sheet, in particular) and of productivity (machine speed).

In particular, there exists a real need to find a means which makes it possible to manufacture paper under conditions corresponding to practical requirements and which does not in any way require the systematic use of amphoteric starches, of starches of different ionicities and/or of complex silica-based systems.

It is to the credit of the Applicant Company that it has found that such a means could be constituted, including under conditions regarded as difficult (pulp composed of RCF or old papers, significant closure of the circuits), by the use, on the one hand, of a cationic starch exhibiting a sufficiently high level of nitrogen and, on the other hand, of a specific aluminium compound.

More precisely, the subject of the present invention is a process for the manufacture of paper from a fibrous composition, characterized in that the said fibrous composition is brought into contact, simultaneously or non-simultaneously, with at least one cationic starch exhibiting a level of fixed nitrogen greater than 0.95%, expressed with respect to the dry weight of starch, and with at least one polyaluminium compound.

The cationic starchs used in accordance with the invention can be obtained by any current or future technique, in aqueous medium, in solvent medium or in the dry phase, capable of enabling one or a number of nitrogenous group(s) of electropositive nature to become fixed to a starch or a mixture of starches of any nature and origin, provided that the level of nitrogen thus fixed is greater than 0.95% by weight of dry starch.

The said nitrogenous groups can in particular contain a tertiary or quaternary nitrogen atom, such as the reactants described in the following patents, filed in the name of the Applicant Company:

Patent FR 2,434,821, in particular from page 3, line 29 to page 5, line 10,

Patent EP 139,597, in particular column 1, lines 30 to 52, and

Patent EP 282,415, in particular page 4, lines 5 to 36, these specific passages being included in the present description.

The cationic starches used in the process according to the invention can in particular be prepared by any one of the cationization techniques, in particular dry-phase cationization, described in Patents FR 2,434,821, FR 2,477,159, EP 233,336, EP 303,039, EP 333,292, EP 406,837, U.S. Pat. No. 4,332,935 and U.S. Pat. No. 429,444.

The cationic starches used according to the invention can moreover be of "polycationic" nature, such as those described in the abovementioned Patents EP 406,837 and U.S. Pat. No. 429,444, provided that the said starches exhibit, in fine, a level of fixed nitrogen greater than 0.95% with respect to the dry weight of starch.

Preferably, in the context of the invention, recourse is had to starches exhibiting a level of fixed nitrogen of approximately 1.0% to approximately 3.0%, preferably of approximately 1.0% to approximately 2.5% and, more preferentially still, of 1% to 1.6%, with respect to the dry weight of starch.

The said starches, of natural or hybrid origin, can be based on potato, potato containing a high amylopectin content (waxy starch), maize, wheat, maize containing a high amylopectin content (waxy maize), maize containing a high amylose content, rice, peas or manioc, based on cuts or fractions which can be prepared or obtained therefrom, such as amylose, amylopectin or particle-size cuts known to the person skilled in the art under the terms wheat starch "A" and wheat starch "B", and any mixtures containing at least any two of the abovementioned products.

The cationic starch which can be used for the manufacture of paper according to the invention can therefore in particular be composed of a mixture of at least one cationic tuber starch, in particular a cationic potato starch, and of at least one cationic cereal starch, in particular cationic maize or wheat starch.

Use can in particular be made of mixtures exhibiting cationic potato starch/cationic wheat or maize starch ratios by weight ranging from approximately 10/90 to approximately 90/10 and in particular from 20/80 to 80/20, it being understood that the cationization may have been carried out, as described in Patent EP 139,597 in the name of the Applicant Company, on the mixture of the two starches or, separately, on each of the two starches, which are subsequently mixed.

The cationic starches used in the process for the manufacture of paper according to the invention, which starches exhibit a level of fixed nitrogen greater than 0.95% with respect to the dry weight of starch, can simultaneously with, prior to or subsequent to the cationization have been subjected to any chemical and/or physical treatment.

The chemical treatment can in particular comprise one or other of the known techniques for crosslinking, oxidation, alkaline treatment, acid and/or enzymatic hydrolysis, esterification or plasticization.

"Technique for crosslinking" is understood to mean, in particular, any process which uses an agent such as adipic acid or one of its derivatives, a halohydrin (for example epichlorohydrin), a trimetaphosphate (for example sodium trimetaphosphate), phosphorus oxychloride or a resin (for example based on formaldehyde).

"Oxidation technique" is understood to mean, in particular, any non-degradative oxidation process which allows the substitution of at least one OH group of starch by a COOH group.

Among such processes, so-called "selective" oxidation techniques will advantageously be resorted to, that is those allowing the substantial oxydation of the sole hemiacetal terminal functional group of the starting starch, said starch may already have been cationized before being selectively oxidised in this way. Such techniques are described, inter-alia, in EP 23 202 and EP 562 927.

"Esterification technique" is understood to mean, in particular, any process allowing the substitution of the starch (already cationized or not), at least in one place, by acetate, phosphate, succinate, sulfo-succinate, alkenyl-succinate, sulfate, maleate, propionate or carboxyl groups.

As a result, the starches used in the process for the manufacture of paper according to the invention can comprise amphoteric starches, that is, products which are both cationic (fixed nitrogen ratio above 0.95% with respect to the dry weight of starch) and anionic.

In terms of physical modification, the cationic starches can easily be used (for the purpose of being brought into contact with the fibrous composition) in the form of dilute aqueous sizes of variable concentrations, generally less than 20% and preferably between approximately 15% and approximately 1%.

The sizes are prepared in a way known per se by non-continuous or continuous cooking, for example at 110°–130° C., in a continuous pressurized cooker or "jet cooker" capable of performing the metering, cooking and diluting operations.

According to an advantageous embodiment of the invention, provision can be made for the starch to be in the form of an uncooked or pregelatinized starch powder, prior to being and/or when it is brought into contact with the fibrous composition.

The Applicant Company has in particular observed that the high level of fixed nitrogen characteristic of the starches used in the context of the invention could enable the latter to dissolve satisfactorily (i.e. not instantaneously but gradually) under temperature conditions which are very significantly lower than those adopted in the jet cooker, for example at temperatures of between 10° and 50° C. approximately. Thus, starch powders can advantageously be brought into contact, by any appropriate means, with fibrous compositions, the temperature of which is, by any appropriate means, brought to and/or maintained at a value of approximately 25° C. to approximately 50° C.

Thus, the present invention makes it possible, inter alia and according to the nature of the starches which it employs, to simplify certain processes for the manufacture of paper by dispensing with traditional means for the continuous or non-continuous cooking of starch.

According to another alternative form of the process according to the invention and independently of the way in which it will subsequently be cooked and used in papermaking, the cationic starch has a viscosity of approximately 300 to approximately 3000, and preferably of 350 to 2500, Brabender units (BU).

The said viscosity is measured on a device of "Brabender 350 CMG" type. A starch sample (25.0 g) is used in a sufficient amount of water to obtain an overall charge of 480 g. The latter is introduced into the cooking chamber of the viscosimeter. Cooking is carried out in a controlled way (1.5° C./min) and the viscosity of the size is assessed after the latter has been brought to and then maintained for 20 minutes at a temperature of 92° C.

Purely by way of indication, the Applicant Company has observed that cationic starches exhibiting a level of fixed nitrogen of 1 to 1.6% and a viscosity of 900 to 2100 BU were of particular advantage in the context of the present invention.

According to another alternative form of the process according to the invention, the cationic starch and the fibrous composition are brought into contact under conditions such that the said cationic starch represents from approximately 0.2 to approximately 6%, preferably from 0.3 to 4% and more preferentially still from 0.7 to 3% of the weight of the said fibrous composition.

Moreover, and as already specified, in the context of the present invention, the specific cationic starch as described above is used in combination with at least one "anionic trash catcher" of specific type, namely a polyaluminium compound.

"Polyaluminium compound" is understood to mean, within the meaning of the present invention, in particular the products which are commonly known as "aluminium polyhydroxide", "aluminium polychloride", "basic aluminium polychloride", "basic aluminium polychlorosulphate" or "aluminium polysulphate" and preferably comprises one or a number of the following products:

1. the salts of formula:

$$Al_n(OH)_mX_{3n-m} \quad (I)$$

in which X is Cl, $NO_3$ or $CH_3$ COO, n is any number, 3n−m is positive and m and n are positive integers, it being possible for the said salt additionally to contain a polyvalent anion Y chosen from the anions of sulphuric, phosphoric, polyphosphoric, silicic, chromic, carboxylic and sulphonic acids, the Y/Al molar ratio preferably being between 0.015 and 0.4 and the basicity or the m/3n ratio being between 0.1 and 0.9 and preferably between 0.2 and 0.85. Such salts can in particular consist of or resemble the products "Tenfloc 18" or "PAC 18" and "Ekoflock" supplied by Eka-Nobel or Akzo-Nobel;

2. the salts of formula:

$$Al_n(OH)_mCl_{3n-m-2k}\,(SO_4)_k \quad (II)$$

in which k, m and n are positive integers and 3n>m+2k, the basicity or the m/3n ratio is preferably between 0.3 and 0.7 and k/n preferably between 0.01 and 0.03;

3. the salts of formula:

$$(Al_n(OH)_{3n-m-2p}Cl_m(SO_4)_p)_z \quad (III)$$

in which (3n−m−2p)/3n=0.4 to 0.7, p=0.04 to 0.25 n, m/p =8 to 35, k, m, n and p are integers and z is at least 1;

4. the basic aluminium chlorosulphates of formula:

$$Al_nOH_m(SO_4)_kCl_{3n-m-2k} \quad (IV)$$

in which the basicity or the (m/3n)×100 molar ratio is generally between approximately 40% and approximately 65%, which exhibit an Al equivalent/Cl equivalent ratio preferably of between 2.8 and 5. A salt corresponding to the formula IV consists in particular of WAC supplied by Elf-Atochem;

5. the salts of formula:

$$(Al(OH)_x(SO_4)_y(H_2O)_3)_n \quad (V)$$

where x=1.5 to 2.0, y=0.5 to 0.75, x+2y=3 and z=1.5 to 4.0.

According to an alternative form of the invention, the polyaluminium compound advantageously comprises a salt of formula I, II, IV or V and in particular comprises a product of WAC, PAC 18 or Ekoflock type.

Such polyaluminium compounds are in particular described in the abovementioned documents:

Patent Application FR 2,418,297, page 2, lines 1 to 14,

Patent Application EP 522,940, page 3, lines 19 to 49, and

Patent Application WO 94/01619, page 4, line 6 to page 5, line 17, these passages being included in the present description.

The polyaluminium compounds used according to the present invention preferably have an aluminium content, expressed as $Al_2O_3$, of approximately 8% to approximately 20% by weight and in particular of 10% to 18% by weight.

According to another alternative form of the process according to the invention, the polyaluminium compound and the fibrous composition are brought into contact under conditions such that the said polyaluminium compound, expressed as weight of $Al_2O_3$, represents from approximately 0.01% to approximately 0.5% and preferably from 0.015% to 0.4% of the weight of the said fibrous composition.

As regards conditions for bringing the cationic starch, the polyaluminium compound and the fibrous composition into contact with one another, the very great and surprising flexibility of the process for manufacturing paper according to the invention should be emphasized.

In fact, and contrary to the general teachings of the prior art, the process in accordance with the invention does not in any way require that the cationic starch should be brought into contact with the fibrous composition prior to the polyaluminium compound or, conversely, that the polyaluminium compound should be brought into contact with the fibrous composition prior to the cationic starch. The Applicant Company has even observed that it was entirely possible to bring the cationic starch and the polyaluminium compound into contact simultaneously or virtually simultaneously with the fibrous composition.

In addition, it was found that the polyaluminium compound could, in particular in highly closed circuits, be introduced, completely or in part, at the same point as the white waters.

Although it is possible, as specified above, to employ the cationic starch and the polyaluminium compound in any order and at any point in the wet end of the paper machine, including from the pulper to the head box, it is preferable:

to bring the cationic starch into contact with the fibrous composition between a point corresponding to the refiner and a point lying just before the head box, preferably between a point lying just after the refiner and a point lying just before the mixing pump of the paper machine, to bring the polyaluminium compound into contact with the fibrous composition between a point corresponding to the refiner and a point corresponding to the head box and/or to the white waters and, preferably, between a point lying just after the refiner and a point lying just before the head box of the paper machine.

The polyaluminium compound can in particular be brought into contact with the fibrous composition between a point corresponding to the first chest of the wet end of the paper machine and a point lying just after the cleaner of the paper machine.

As has been specified, the cationic starch and the polyaluminium compound can be introduced in any order in the wet end of the paper machine, including being brought into contact with the fibrous composition simultaneously or virtually simultaneously.

As a result of which, the time period between bringing either the cationic starch or the polyaluminium compound respectively into contact with the fibrous composition and bringing either the polyaluminium compound or the cationic starch respectively into contact with the fibrous composition is generally at most equal to approximately 120 minutes and in particular is between 0 and 60 minutes, preferably between 0 and 45 minutes and more preferentially between 10 seconds and 40 minutes.

In practice, time periods of the order of 25 seconds to 35 minutes, in particular 30 seconds to 20 minutes, will generally be envisaged between the respective use of the two products (cationic starch and polyaluminium compound, in any order).

As has been indicated above and as will result from the examples below, the process for the manufacture of paper according to the invention exhibits, inter alia, and in addition to being simple and profitable, the advantages of making it possible, in particular under difficult conditions (pulps composed of RCF or old papers, significant closure of the circuits), to obtain good retention of the starch, to improve the physical characteristics of the paper and to provide a machine speed corresponding to practical requirements, indeed to improve the said machine speed, and therefore, overall, to improve the profitability of the system.

The Applicant Company has surprisingly and unexpectedly found that the use, simultaneously or non-simultaneously, of a polyaluminium compound and a cationic starch with a high level of fixed nitrogen in accordance with the invention made it possible, in particular, to dispense with all or part of certain surface treatments applied to the sheet after its formation.

In fact, to obtain a paper (in particular a paper obtained under difficult conditions) having acceptable, or enhanced, mechanical characteristics, it is generally necessary to subject the paper produced to a surface treatment carried out in particular using a machine of the "size press" type. Such a treatment, applied to either or both faces of the paper, generally makes it possible to increase the proportion of starch, whether native or physically and/or chemically modified starch, forming part of the composition of this paper, thus giving it an improved strength.

Now, such a solution is not satisfactory from the economic viewpoint, any additional operation being expensive. Passage through the "size press" results, in addition to an additional expense related to the equipment and to the additional drying operation which it involves, in a significant decrease, generally of the order of 15 to 25%, in the speed of the machines and thus in the rate of paper production.

As a result of which, the process according to the invention is characterized in that the paper obtained is not subjected, on either of its two faces or indeed on both its two faces, to any surface treatment employing a native or physically and/or chemically modified starch.

Another predominant advantage of the process for the manufacture of paper according to the invention is, as indicated above, to make it possible, with respect to the techniques of the prior art, to obtain an improved level of retention of starch, without having a negative effect on the physical characteristics of the paper, and/or to obtain improved physical characteristics of the paper, without having a negative effect on the level of retention of starch.

In addition, and in an entirely remarkable way, the process which is the subject of the present invention is capable, including under difficult conditions (pulps based on RCF or old papers, significant closure of the circuits), of significantly improving both the level of retention of starch and the physical characteristics of the paper, as will be shown in the examples below.

Within the context of the present invention, the notion of paper is, as specified at the beginning of the description, in no way limiting and encompasses, in particular, papers for graphical uses (in particular for printing/writing, for ink-jet printing, for offset printing or for reprography) and papers for wrapping and packaging (papers for corrugated fibreboard, for soft wrappings of thin kraft type, or others).

The Applicant Company has in particular observed that the process according to the invention was particularly well suited to the manufacture of paper of liner or fluting type for corrugated fibreboard.

In particular, the process according to the invention makes it possible to obtain fluting paper for corrugated fibreboard under improved conditions (retention of starch, machine speed) with respect to the techniques of the prior art and/or which has improved characteristics with respect to the said techniques.

The Applicant Company in particular has emphasized that the process according to the invention was particularly suited to:

being applied to the manufacture of non-surface-treated fluting paper for corrugated fibreboard having physical characteristics which are entirely compatible with current practical requirements, the said characteristics being expressed, as indicated below, as "CMT value" (according to NF standard Q03-044 or ISO standard 7263) and as "Mullen value" (burst ratio according to NF standard Q03-053 or ISO standard 2758).

As a result of which, the present invention is characterized in that the paper obtained is a paper for graphical use or a paper for wrapping or packaging, in particular a fluting paper or a liner paper for corrugated fibreboard.

In particular, the process in accordance with the invention makes it possible to prepare a fluting paper for corrugated fibreboard which is not surface-treated and which has a substance of 120 to 130 g/m$^2$, in particular obtained from old papers, exhibiting:

a CMT 60 value of at least approximately 130, preferably of at least approximately 135, expressed as N, a Mullen value of at least approximately 1.65, preferably of at least approximately 1.70, expressed as KPa/g/m$^2$.

To the knowledge of the Applicant Company, such papers are novel industrial products.

In addition, the fibrous composition used in the context of the present invention advantageously has a so-called "neutral" or "pseudoneutral" pH, namely from approximately 6.0 to approximately 8.0 and preferably from 6.1 to 7.1, it being possible for the said pH to be controlled or uncontrolled ("free pH"), as can be the case under difficult operating conditions.

As a result of which, the present invention is also characterized in that the fibrous composition exhibits a pH, controlled or uncontrolled, lying between approximately 6.0 and approximately 8.0 and preferentially between 6.1 and 7.1.

Moreover, the said fibrous composition can contain and/or be brought into contact with, where necessary, one or other of the products recommended in the abovementioned patents of the prior art, including at least one product chosen from anionic starches, such as phosphorylated or sulphosuccinylated starches, sizing agents, such as alkylketene dimers and succinic acid anhydrides, fillers, such as calcium carbonate and kaolin, retention agents, such as polyacrylamides, polyethyleneimines, polyalkylammonium chlorides and other synthetic retention agents, or silicic and aluminosilicic compounds.

In particular, the said fibrous composition can, advantageously and at any time, contain and/or be brought into contact with a silicic or aluminosilicic compound such as those described in the abovementioned Patents EP 041,056 and EP 0,522,940 and, optionally, a sizing agent and/or a filler.

This silicic or aluminosilicic compound can be introduced into the fibrous composition simultaneously with the starch or at a different time, subsequently or previously, generally a few seconds to a few minutes before or after the said cationic starch is introduced.

As a result of which, the process for the manufacture of paper according to the invention is also characterized in that the fibrous composition is brought into contact, at any time whatever before the formation of the sheet, with at least one silicic or aluminosilicic compound, in particular with a colloidal silicic acid, the particles of which have a specific surface of approximately 50 to approximately 1000 m$^2$/g, and optionally with at least one filler or one sizing agent.

The invention can be still better understood with the help of the following examples which give instances of certain particularly advantageous embodiments of the process for the manufacture of paper according to the invention.

EXAMPLE 1

Starting with a thick pulp based on old papers, a fibrous composition (pulp) is reconstituted, by dilution in water, which exhibits the following main characteristics:

| | |
|---|---|
| pH | 6.6 |
| Overall concentration | 16.8 g/l |
| Concentration of soluble components | 13.7 g/l |
| Acidity | 0.24 g/l |
| Resistivity | 150 ohms |
| Total ash | 12.4 g/l |
| Soluble ash | 8.9 g/l |

Within the context of this example, which represents difficult conditions for the preparation of paper, a study is carried out of the behaviour (level of retention of starch, Mullen value and CMT 60 value) of the different cationic or amphoteric starches below, optionally in combination with a polyaluminium compound denoted below by the generic term "PAC".

Starch A: Cationic (potato) starch exhibiting a level of fixed nitrogen of approximately 1% with respect to the dry weight of starch.

Starch B: 25/75 mixture of a cationic starch and of a cationic wheat starch exhibiting a level of fixed nitrogen of approximately 1.2%.

Starch C: Cationic starch containing 0.8% of fixed nitrogen.

Starch D: 25/75 cationic starch/cationic wheat starch mixture containing 0.65% of fixed nitrogen.

Starch E: Amphoteric waxy maize starch of phosphate type exhibiting a level of fixed nitrogen of 0.25%.

Starch F: Amphoteric starch of sulphosuccinate type exhibiting a level of fixed nitrogen of 0.25%.

All these starches were prepared in the form of sizes on a continuous cooking device under the following conditions:

milk containing 10% of dry matter (DM), cooking temperature: 120° C., duration of cooking: 20 seconds, in-line dilution: 700 l/hour, absence of pump at the cooker outlet.

These different cationic or amphoteric starches are tested, optionally in combination with a PAC, in this case "PAC 18", on a Techpap "automatic retention handsheet machine".

These tests are carried out at a concentration of 2% of starch and, when it is present, of 1% of PAC.

The contact time between the starch and the fibrous composition is 5 minutes. The contact time between the PAC (when it is used) and the fibrous composition is 6 minutes.

For each of the starches A to G, optionally in combination with a PAC ("PAC 18"), the following parameters are measured:

level of fixed starch, hereinafter denoted "SR", in %,

Mullen value, hereinafter denoted "Mullen", as KPa/g/m$^2$ (according to NF standard Q03-053 or ISO standard 2758), CMT 60 value, hereinafter denoted "CMT", as N (according to NF standard Q03-044 or ISO standard 7263).

It should be recalled that the Mullen value makes it possible to evaluate the resistance to bursting of a paper (for example a liner paper for corrugated fibreboard) subjected to an increasing hydrostatic pressure perpendicularly to its surface, the said number taking into account the substance of the said paper.

The CMT 60 value is itself particularly suited to the evaluation of a fluting paper for corrugated fibreboard and in particular to the determination of the flat crush resistance of such a paper.

As reference tests, the behaviour obtained in the absence of any starch and of any PAC (Test 1) or in the absence of starch but in the presence of PAC (Test 2) is studied.

The results obtained ("SR", "Mullen" and "CMT" as defined above) are detailed below as a function of the type of starch and of the presence or absence of PAC.

TABLE 1

| Test | Type of Starch | PAC | SR | Mullen | CMT |
|---|---|---|---|---|---|
| 1 | — | – | – | 1.42 | 117 |
| 2 | — | + | – | 1.32 | 120 |
| 3 | A | – | 44 | 1.51 | 134 |
| 4 | A | + | 60 | 1.74 | 136 |
| 5 | B | – | 46 | 1.53 | 133 |
| 6 | B | + | 62 | 1.75 | 142 |
| 7 | C | – | 48 | 1.64 | 132 |
| 8 | C | + | 56 | 1.72 | 125 |
| 9 | D | – | 25 | 1.63 | 140 |
| 10 | D | + | 19 | 1.54 | 148 |
| 11 | E | – | ND* | 1.61 | 138 |
| 12 | E | + | ND | 1.58 | 134 |
| 13 | F | – | 38 | 1.63 | 146 |
| 14 | F | + | 38 | 1.57 | 142 |

*ND = Not determined

The overall result of the above results is that:

1) a cationic starch, not in combination with a PAC (cf. Tests 3, 5, 7, 9 and 11), does not make it possible, under the conditions of these tests, to obtain a combined behaviour which is entirely satisfactory, in particular if the levels of retention of starch (SR) and the Mullen values obtained are considered. In particular, in the absence of PAC, paper simultaneously exhibiting, in addition to good SR (≧50%), a Mullen value at least equal to 1.65 and a CMT 60 value at least equal to 130 is not obtained, 2) a PAC not used in combination with a cationic starch (cf. Test 2) is entirely ineffective, 3) only those cationic starches (including a mixture of cationic starches—cf. Test 6) exhibiting a sufficiently high level of fixed nitrogen and used in combination with a PAC (cf. Tests 4 and 6) make it possible to obtain a combined behaviour which is satisfactory, namely, in addition to a good SR (≧50%, in particular ≧60%), Mullen and CMT 60 values capable of satisfying practical requirements, 4) comparison of the results obtained in the context of Tests 8 and 10 (not in accordance with the invention) and in the context of Tests 4 and 6 (in accordance with the invention), respectively, shows in particular the advantages afforded by a level of fixed nitrogen greater than 0.95% in terms of CMT 60 value and/or of Mullen value. It will be noted that, in the case of Test 8, the use of the PAC has in addition lowered the Mullen value. In addition, Test 10 shows results which are particularly unsatisfactory in terms of Mullen value and of SR, the value of these parameters being moreover lowered by the presence of PAC, 5) the propositions of the prior art, which recommend, very generally and nonspecifically in combination with a PAC, the use of amphoteric starches of phosphate type (cf. Test 12) or of sulphosuccinate type (cf. Test 14), are not entirely satisfactory, in particular in terms of Mullen value and of starch retention. Moreover, it is noted that the use of a PAC in combination with such amphoteric starches has a detrimental effect on the already average behaviour of the said starches.

The account given above shows the industrial advantages afforded by the manufacturing process according to the invention, which makes it possible, inter alia, and by virtue of the physical characteristics which it confers on the paper obtained, to dispense, if needs be, with the subsequent surface treatment operations of the paper, with the disadvantages of which in terms of cost, machine speed and productivity have been recalled above.

EXAMPLE 2

Moreover, the Applicant Company has confirmed from every angle, on a Techpap small handsheet machine, the advantage of the process which is the subject of the invention, in particular in terms of starch retention and/or of chemical characteristics of the paper, in the circumstances defined below.

* Test 15 fibrous composition: identical to the pulp tested in Tests 1 to 14 ("Pulp 1"), starches used: 1% of starch of type A+1% of anionic starch of Vector® A180 type marketed by the Applicant Company, PAC used: 2% of "PAC 18", starch A contact time: 5 min, PAC 18 contact time: 6 min, Vector® A180 contact time: 1 min, substance of the paper: 123 g/m$^2$.

Under these conditions, a Mullen value of 1.71 and a CMT 60 value of 137 are obtained.

* Test 16 fibrous composition: Pulp 1, starch used: 2% of starch A in the form of an uncooked starch powder, PAC used: 2% of "PAC 18", starch A contact time: 6 min, with prior heating for 10 min at 45° C. for the purpose of dissolving the starch, PAC 18 contact time: 6 min, substance of the paper: 127 g/m$^2$.

Under these conditions, entirely satisfactory physical characteristics (including a CMT 60 value of 136) and, in addition, an exceptional level of retention of starch for such a type of fibrous composition, namely greater than 90%, are obtained. This test shows that it is possible, within the context of the invention, to use an uncooked starch, a fortiori pregelatinized, provided that the operating conditions, upstream and/or at the level even of the pulp, make it possible to bring the cationic starch and PAC into contact at a suitable temperature, for example from 20° to 50° C. (in the present case: 45° C.), conditions which are used in practice by certain paper manufacturers. The use of a conventional, continuous or non-continuous cooker can thus be dispensed with.

* Test 17 fibrous composition: pulp reconstituted from a thick pulp based on old papers exhibiting a pH of 7.0, an overall concentration of 7.17 g/l, a concentration of soluble components of 3.32 g/l and a resistivity of 457 ohms, starch used: 2% of starch A, PAC used: 1% of basic aluminium polychlorosulphate of "WAC" type, starch A contact time: 4 min 30, WAC contact time: 5 min substance of the paper: 135 g/m$^2$.

Under these conditions (fibrous composition other than Pulp 1, in particular), a particularly high Mullen value (value: 1.80) and a particularly high level of retention of starch (value: 95%) are obtained.

We claim:

1. A process for the manufacture of paper from a fibrous composition, said process comprising: adding at least one cationic starch exhibiting a level of fixed nitrogen greater than about 0.95%, expressed with respect to the dry weight of starch, and a sufficient amount of at least one polyaluminium compound to an aqueous slurry of a fibrous composition to form a resultant fibrous composition comprising said at least one polyaluminium compound in an amount within a range of about 0.01% to about 0.5% by weight and forming paper from said resultant fibrous composition.

2. The process according to claim 1, wherein said cationic starch exhibits a level of fixed nitrogen within a range of approximately 1.0% to approximately 3.0%.

3. The process according to claim 1, wherein said cationic starch is selected from the group consisting of uncooked starch powder and pregelatinized starch powder when said cationic starch contacts said fibrous composition.

4. The process according to claim 1, wherein said polyaluminium compound is selected from the group consisting of an aluminium polyhydroxide, an aluminium polychloride, a basic aluminium polychloride, a basic aluminium polychlorosulphate and an aluminium polysulphate.

5. The process according to claim 1, wherein said process is performed using an apparatus comprising a refiner and a head box, and said process comprises contacting said fibrous composition with said cationic starch between a point corresponding to the refiner and a point lying just before the head box, and contacting said fibrous composition with said polyaluminium compound between a point corresponding to the refiner and a point corresponding to the head box.

6. The process according to claim 1, wherein the time period between contacting said fibrous composition with said cationic starch, and contacting said fibrous composition with said polyaluminium compound is between 0 and about 60 minutes.

7. The process according to claim 1, wherein said paper is essentially devoid of a member selected from the group consisting of a native starch, a physically modified starch, and a chemically modified starch.

8. The process according to claim 1, wherein said paper is selected from the group consisting of a paper for graphical use, a paper for wrapping, and a paper for packaging.

9. The process according to claim 1, wherein said fibrous composition exhibits a pH within a range of between approximately 6.0 and approximately 8.0.

10. The process according to claim 1, comprising: contacting said fibrous composition with at least one member selected from the group consisting of a silicic compound and a aluminosilicic compound, the particles of which have a specific surface of approximately 50 to approximately 1000 m$^2$/g prior to forming said fibrous composition into a sheet.

11. The process according to claim 2, wherein said cationic starch exhibits a level of fixed nitrogen within a range of about 1.0% to about 2.5%.

12. The process according to claim 2, wherein said cationic starch exhibits a level of fixed nitrogen within a range of about 1.0% to about 1.6%.

13. The process according to claim 3, wherein the fibrous composition comprises a temperature within a range of approximately 25° C. to approximately 50° C.

14. The process according to claim 4, wherein said polyaluminium compound exhibits an aluminium content, expressed as $Al_2O_3$, within a range of approximately 8% to approximately 20% by weight.

15. The process according to claim 4, wherein said polyaluminium compound exhibits an aluminium content, expressed as $Al_2O_3$, within a range of about 10% to about 18% by weight.

16. The process according to claim 5, wherein said apparatus comprises a mixing pump of a paper machine and said process comprises contacting said fibrous composition between a point lying just after the refiner and a point lying just before the mixing pump of the paper machine.

17. The process according to claim 5, wherein said process is performed using an apparatus comprising a refiner and a head box, and said process comprises contacting said fibrous composition with said polyaluminium compound between a point lying just after the refiner and a point lying just before the head box of the paper machine.

18. The process according to claim 6, wherein said time period is between 0 and about 45 minutes.

19. The process according to claim 6, wherein said time period is between about 10 seconds and about 40 minutes.

20. The process according to claim 1, wherein resultant paper is selected from the group consisting of a fluting paper and a liner paper for corrugated fiberboard.

21. The process according to claim 9, wherein the pH is between 6.1 and 7.1.

22. The process according to claim 10, wherein the at least one member selected from the group consisting of the silicic and the aluminosilicic compound comprises a colloidal silicic acid.

23. The process according to claim 10, comprising contacting said fibrous composition, before formation said fibrous composition into a sheet, with at least one member selected from the group consisting of a filler and sizing agent.

24. The process according to claim 22, comprising contacting said fibrous composition, before formation of said fibrous composition into a sheet, with at least one member selected from the group consisting of a filler and sizing agent.

* * * * *